US007661931B1

(12) United States Patent
Matheny

(10) Patent No.: US 7,661,931 B1
(45) Date of Patent: Feb. 16, 2010

(54) BLADED ROTOR WITH SHEAR PIN ATTACHMENT

(75) Inventor: Alfred P. Matheny, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 535 days.

(21) Appl. No.: 11/708,215

(22) Filed: Feb. 20, 2007

(51) Int. Cl.
*F01D 5/32* (2006.01)

(52) U.S. Cl. ..... 416/220 R; 416/221

(58) Field of Classification Search ..... 416/220 R, 416/221

See application file for complete search history.

(56) References Cited

U.S. PATENT DOCUMENTS

| | | | | |
|---|---|---|---|---|
| 1,050,187 | A | 1/1913 | Westinghouse | |
| 1,347,031 | A | 7/1920 | Guy | |
| 1,415,266 | A | 5/1922 | Rice | |
| 2,430,185 | A | 11/1947 | Pescott | |
| 2,651,494 | A | 9/1953 | Persson | |
| 2,658,718 | A | 11/1953 | Walker | |
| 2,974,924 | A | 3/1961 | Rankin et al. | |
| 2,974,942 | A * | 3/1961 | Rankin et al. | 266/152 |
| 3,158,353 | A * | 11/1964 | Reid et al. | 416/220 R |
| 3,313,519 | A * | 4/1967 | Jenson | 416/221 |
| 4,767,275 | A | 8/1988 | Brown | |
| 5,073,084 | A | 12/1991 | Hirst | |
| 5,129,786 | A | 7/1992 | Gustafson | |
| 5,368,444 | A | 11/1994 | Anderson | |
| 5,372,481 | A | 12/1994 | Boyd | |
| 5,380,157 | A | 1/1995 | Shaffer | |
| 5,435,693 | A | 7/1995 | Shaffer | |
| 5,601,407 | A | 2/1997 | Humhauser | |
| 5,860,787 | A | 1/1999 | Richards | |
| 6,499,959 | B1 | 12/2002 | Reluzco et al. | |
| 6,761,537 | B1 | 7/2004 | Shapiro et al. | |

* cited by examiner

*Primary Examiner*—Ninh H Nguyen
(74) *Attorney, Agent, or Firm*—John Ryznic

(57) ABSTRACT

A fan type compressor includes a rotor disk with a plurality of root insertion openings to receive a blade. Each insertion opening includes two shear pin slots on the sides, and the blade includes a root portion with shear pin slots formed on the pressure side and the suction side of the root. The blade is inserted into the insertion opening such that the slots are aligned, and a shear pin is inserted into both slots to secure the blade within the rotor disk. The shear pin slots are formed below the airfoil curvature and follow the airfoil curvature at the root portion. The shear pins are flexible enough to bend during insertion into the slots, and are strong enough to prevent from shearing off during rotor disk operation. The blade attachment structure provides for reduction of the dead weight from the attachment structure in order to simulate an IBR while providing for easy removal and replacement of a damaged blade.

8 Claims, 2 Drawing Sheets

SECTION A-A

BLADED ROTOR WITH SHEAR PIN ATTACHMENT

CROSS-REFERENCE TO RELATED APPLICATIONS

This application is related to U.S. Regular patent application Ser. No. 11/605,857 filed on Nov. 28, 2006 by Alfred P. Matheny and entitled TURBINE BLADE WITH ATTACHMENT SHEAR PINS.

BACKGROUND OF THE INVENTION

1. Field of the Invention

The present invention relates generally to fluid reaction surfaces, and more specifically to attaching a compressor blade to a rotor disk.

2. Description of the Related Art Including Information Disclosed Under 37 CFR 1.97 and 1.98

A turbomachine includes a rotor disk with a plurality of rotor blades secured to the disk and spaced circumferentially around the disk. In some turbo-machines, the rotor disk rotates with such a high speed that the centrifugal forces are very high and tend to pull the blade out from the disk. Therefore, the structure in which the blade is secured to the rotor disk is very important.

Another problem with turbo-machines is the replacement of a damaged blade. It is desirable to make the removal and replacement of a damaged blade an easy process in order that the turbomachine can be brought back into operation with a minimal down time. A fan blade assembly used in a gas turbine engine can be an integrally bladed rotor (IBR) in which the rotor disk and the fan blades extending from the rotor are all made as a single piece. The benefits of an IBR is a lighter weight fan blade assembly and the elimination of compressed air leakage through gaps formed between a dovetail slot of the fire tree root of an individual blade attached to the slot. A rotor disk with individual slots for securing the blades to the rotor disk must be massive enough to hold the blades to the disk. This type of rotor disk is heavier than an IBR that compresses the same amount of air. The disadvantage of an IBR is replacing a damaged blade. Since the entire IBR is made of one piece, any damaged blade could result in the entire IBR to be discarded.

One prior art blade attachment method is shown in U.S. Pat. No. 5,129,786 issued to Gustafson on Jul. 14, 1992 and entitled VARIABLE PITCH FAN BLADE RETENTION ARRANGEMENT which discloses a fan blade attached to a disc arm by circular shaped pins secured within first and second seating grooves formed in the blade root and the disc arm opening. One problem with the Gustafson invention is that the circular retaining pins cannot withstand very high shear stress that would result in a turbomachine such as a compressor that operates at high rotational speeds. Another problem with the Gustafson invention is that the resulting force of the fluid acting on the surface of the blade will cause the blade root portion to bend within the supporting opening in the disc arm. In the Gustafson invention, because the retaining pins do not follow the outline of the airfoil surface, the airfoil bending load does not transfer directly to the shear pin.

Another prior art blade retaining method is shown in U.S. Pat. No. 2,974,924 issued to Rankin on Mar. 14, 1961 and entitled TURBINE BUCKET RETAINING MEANS AND SEALING ASSEMBLY which discloses a turbine blade (bucket) attached to the rotor disk by pins fitted within slots on the sides of the blade and the opening of the rotor disk. Four pins for each blade are used, with two pins on each side of the blade root, and where the two pins on the side are angled or offset along a straight line from each other. This offset arrangement of the retaining pins will support the shear loads from the bending force acting on the airfoil surface more than in the above cited Gustafson invention, but still not like the present invention. also, Rankin discloses the retaining pins to be circular or round in cross sectional shape, but also discloses that the pins can have a square cross section (see column 2, line 60).

It is therefore an object of the present invention to provide for a blade retaining method in which the blade can be easily removed and inserted into the rotor disk.

It is another object of the present invention to provide for a retaining pin used to secure a rotor blade within a rotor disk that can withstand high shear stress levels and therefore allow for higher rotational speeds for the bladed rotor disk.

It is another object of the present invention to provide for a blade retaining method in a rotor disk that will transfer more of the airfoil bending force to the shear pin more than any of the cited prior art references.

It is also another object of the present invention to provide for a rotor blade secured to a rotor disk using the well known fir tree configuration that includes all of the above objectives.

BRIEF SUMMARY OF THE INVENTION

A compressor fan with a rotor disk having a plurality of fan blades secured to the rotor disk by flexible shear pins. The rotor disk includes blade insertion holes with shear pin slots formed in the side walls of the slots. A fan blade includes a root section having a shape that fits within the insertion hole of the rotor disk, the root section also having shear pin slots on the sides. The fan blade is inserted into the insertion holes and the shear pin slots aligned. Two shear pins for each fan blade are inserted from a leading edge side of the fan blade to secure the fan blade to the rotor disk. The shear pins and the shear pin slots follow the shape of the airfoil in order to reduce the stress acting on the shear pins from the fan blade bending due to resulting forces. Because of the shear pin sand the slots used to secure the fan blade to the rotor disk, the bladed rotor disk can be made light in weight to simulate an IBR, and also the individual damaged blades can be removed and replaced easily without the required machining in an IBR.

DETAILED DESCRIPTION OF THE INVENTION

Figure 1:
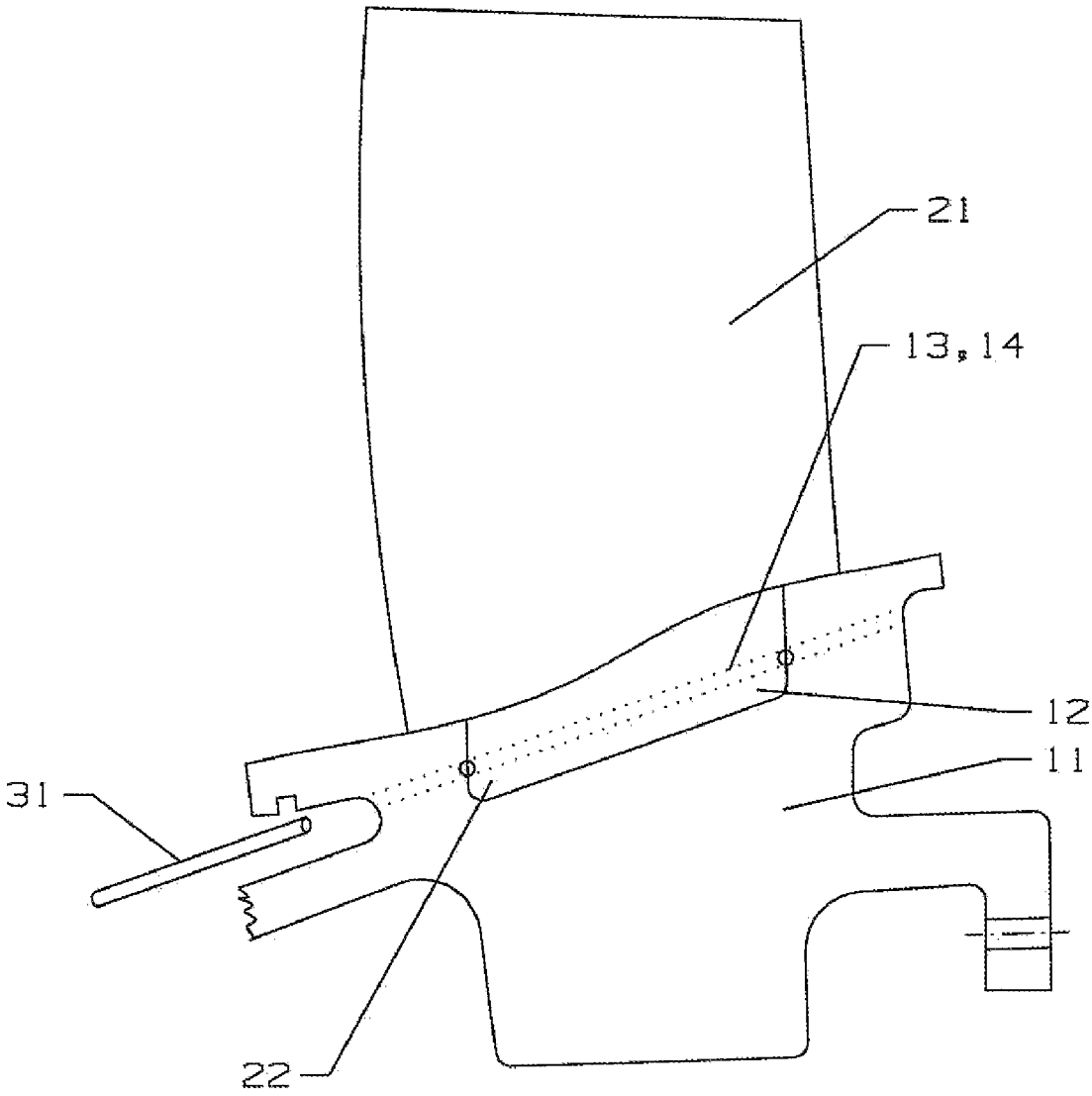
FIG. 1 shows a cross section view of a side of a fan blade secured within a rotor disk of the present invention.

The present invention is a compressor fan used in an aero gas turbine engine in which the fan includes a plurality of fan blades extending from the rotor disk. FIG. 1 shows the bladed rotor disk of the present invention, where a rotor disk 11 includes a plurality of insertion holes 12 each with two shear pin slots 13 and 14 on the sides of the insertion hole 12. The insertion slot 12 ends before the leading edge and the trailing edge of the rotor disk 11. The shear pin slots 13 and 14 extend out from the leading edge of the rotor disk 11 in order to allow for the insertion of shear pins to be described below. The insertion holes 12 take the form of the blade root that is inserted into the insertion holes to be described below.

Figure 3:
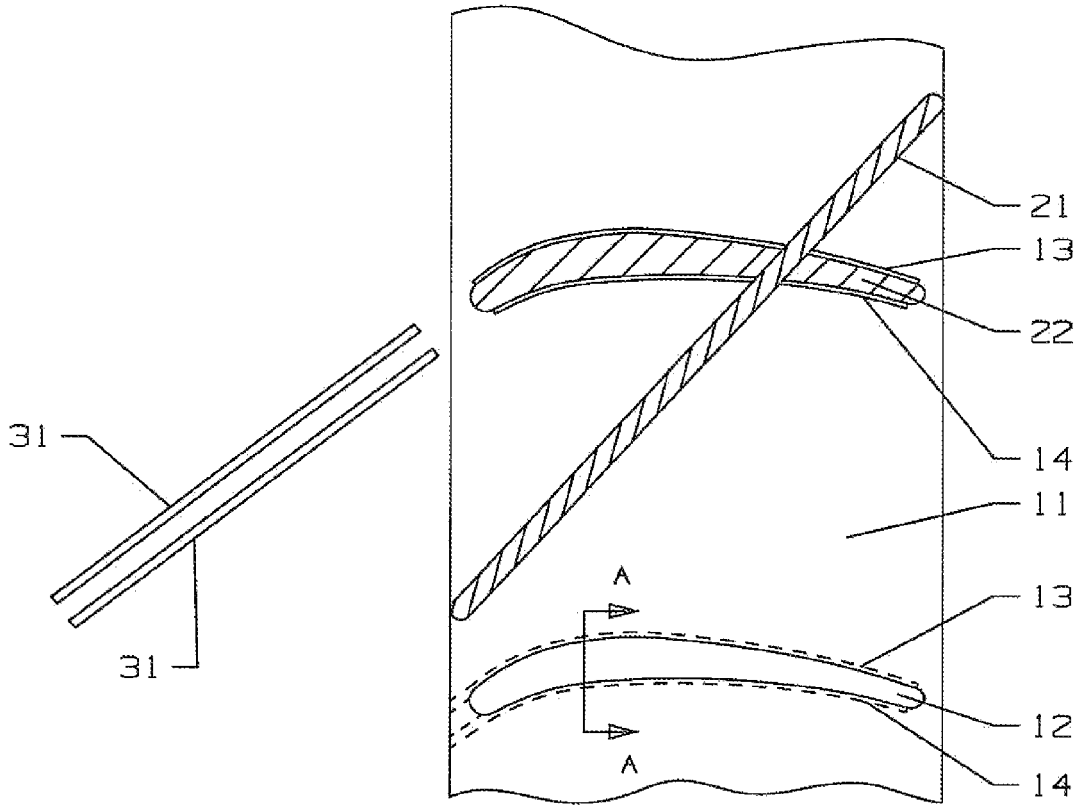
FIG. 3 shows a top view of the fan blade and shear pins of the present invention.

A fan blade 21 is shown in FIG. 1, the fan blade including an airfoil portion 21 and a root portion 22 for insertion into the insertion hole 12. FIG. 3 shows a top view of the fan blade 21 with the root portion 22 inserted into the insertion hole 12. As seen in FIG. 3, the fan blade is twisted from the root portion to the blade tip. The root portion 22 is inserted into the insertion hole 12 to secure the blade 21 within the rotor disk 11. The root portion 22 and the insertion hole 12 are sized such that the blade is secured in the rotor disk 11 against axial and circumferential displacement (all directions except in the radial direction). The root portion 12 of the blade extends below the platform that forms the flow path for the compressed air. As seen in FIG. 1, the root portion 12 extends from a point downstream from the leading edge of the blade such that a lip is formed on the leading edge that rests on top of the rotor disk 11. The root portion 12 extends toward the trailing edge ending at a point upstream there from so that a lip is also formed on the trailing edge side that rests on top of the rotor disk 11.

Figure 4:
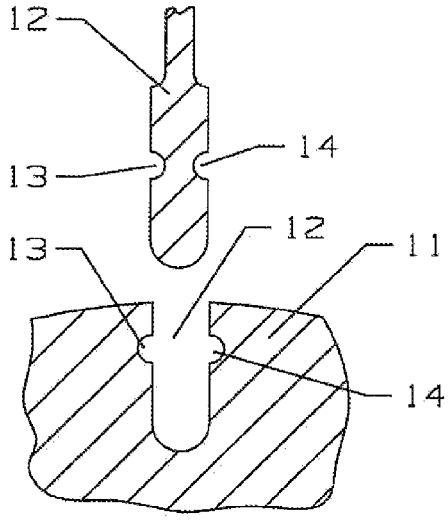
FIG. 4 shows a cross section view of the front of a blade root and the insertion slot of the rotor disk according to the present invention.

FIG. 4 shows the fan blade root portion 22 with the suction side shear pin slot 13 and the pressure side shear pi slot 14 formed within the root 22. The rotor disk 11 is also shown with an insertion hole 12 also having the two shear pin slots 13 and 14 formed therein. When the fan blade root portion 22 is inserted into the insertion hole 12, the shear pin slots 13 and 14 of both the root portion 22 and the insertion hole 12 are aligned with each other to form a shear pin retaining slot. With the fan blade 21 inserted into the insertion hole 12, two shear pins 31 are inserted into the resulting shear pin slot to secure the blade 21 within the rotor disk 11 against radial displacement. As seen in FIG. 1, the 21 includes a platform that slopes upward from the leading edge toward the trailing edge. The insertion slots 13 and 14 follow this upward slope. Because the slots slope upward in this orientation, the slot openings are located on the leading edge side of the rotor disk 11 so that the shear pins will be forced toward the trailing edge during operation of the fan due to centrifugal forces acting on the shear pins.

The shear pin slots 13 and 14 and the shear pins 31 are sized such that the fit is tight enough so that the shear pins 31 will not be forced out from the slots during operation or while the fan assembly is idle. The shear pins 31 are formed of a material that will be flexible enough to conform to the curvature of the slots 13 and 14 while also providing the necessary shear force resistance to prevent the pins 31 from shearing and the fan blade 21 from breaking away from the rotor disk 11.

Figure 2:
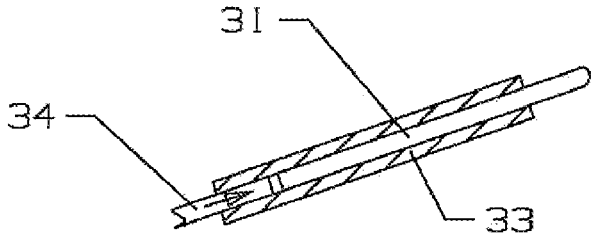
FIG. 2 shows a cross section of a tool used to insert the shear pins into the slots of the present invention.

FIG. 2 shows a tool 33 used to insert the pins 31 into the slots 13 and 14 formed within the blade root 22 and rotor disk 11. The tool includes cylindrical piece 33 with a hole passing through and having the same diameter as the shear pin 31. The cylindrical piece has a length long enough to prevent the shear pin 31 from buckling while a driving tool 34 is used to push the shear pin 31 into the slot 13 and 14. The driving tool 34 would have a hammer head that reciprocates and pounds on the shear pin 31 such as like a hammer drives a nail. The cylindrical piece 33 would have a shear pin 31 placed within the hole, and the cylindrical piece would then be placed up against the opening of the slot while the driving tool 34 hammers the shear pin 31 into the slot. The cylindrical piece 33 would bump up against the slot opening so that the shear pin 31 would not buckle while being driven into position within the slot 13 and 14.

Because of the blade root portion 22 and the insertion hole 12 within the rotor disk with the shear pin slots formed between the root and the insertion hole, the blade attachment arrangement can be made with less mass (resulting in less weight) than would the prior art blade attachment designs such as the dovetail and fir tree design. A lighter weight bladed rotor would allow for rotor disks with less mass and therefore lighter weight than prior art designs and therefore simulate an IBR. Also, the present invention allows for easy replacement of damaged blades that would the real IBR.

As seen in FIG. 1, a small hole could be formed on the trailing edge side of the slots in the rotor disk 11 in order to insert another tool that will push the shear pins 31 out of the slots and allow for removal of the blade. The slots 13 and 14 could also extend out from the rotor disk on the trailing edge side in order to allow for removal of the shear pins. However, a means to prevent the shear pins from coming out of the slots would then be needed, such as a screw cap to close the resulting hole and secure the shear pins 31 within the slots.

I claim the following:

1. A bladed rotor for a compressor comprising:

a rotor disk with a plurality of blade root insertion holes to receive a blade root portion;

each blade insertion hole having a pressure side shear pin slot and a suction side shear pin slot;

a fan blade having an airfoil portion and a root portion, the root portion having shear pin slots formed thereon;

two shear pins inserted into the slots such that the blade insertion hole secures the blade within the rotor disk in the axial and circumferential directions of the rotor disk while the shear pins secure the blade in the radial direction; and, the blade root portion, the insertion hole and the shear pin slots have a curvature in the direction of the rotor disk rotation.

2. The bladed rotor of claim 1, and further comprising:

the blade root portion extends from a point downstream from the leading edge of the airfoil portion and ends at a point upstream from the trailing edge of the airfoil portion.

3. The bladed rotor of claim 1, and further comprising:

the bladed rotor is a bladed rotor disk used as a fan blade in a gas turbine engine.

4. The bladed rotor of claim 1, and further comprising:

the slot in the root portion and the slot in the rotor disk have substantially the same cross sectional shape and width.

5. A bladed rotor for a compressor comprising:

a rotor disk with a plurality of blade root insertion holes to receive a blade root portion;

each blade insertion hole having a pressure side shear pin slot and a suction side shear pin slot;

a fan blade having an airfoil portion and a root portion, the root portion having shear pin slots formed thereon;

two shear pins inserted into the slots such that the blade insertion hole secures the blade within the rotor disk in the axial and circumferential directions of the rotor disk while the shear pins secure the blade in the radial direction; and, the shear pin slots slope upward from a leading edge side to a trailing edge side of the rotor disk; and, the shear pin slots open on the leading edge side of the rotor disk for insertion of the shear pins.

6. A bladed rotor for a compressor comprising:

a rotor disk with a plurality of blade root insertion holes to receive a blade root portion;

each blade insertion hole having a pressure side shear pin slot and a suction side shear pin slot;

a fan blade having an airfoil portion and a root portion, the root portion having shear pin slots formed thereon;

two shear pins inserted into the slots such that the blade insertion hole secures the blade within the rotor disk in the axial and circumferential directions of the rotor disk while the shear pins secure the blade in the radial direction; and, the shear pins are flexible enough to slide into the curved shear pin slots and strong enough to prevent shearing due to centrifugal forces from operation of the bladed rotor.

7. A bladed rotor for a compressor comprising:

a rotor disk with a plurality of blade root insertion holes to receive a blade root portion;

each blade insertion hole having a pressure side shear pin slot and a suction side shear pin slot;

a fan blade having an airfoil portion and a root portion, the root portion having shear pin slots formed thereon;

two shear pins inserted into the slots such that the blade insertion hole secures the blade within the rotor disk in the axial and circumferential directions of the rotor disk while the shear pins secure the blade in the radial direction;

the airfoil has a twist from the root portion to the blade tip; and, the pressure and suction side slots are located substantially below the airfoil surfaces on the respective pressure and suction sides, the slots substantially following the curvature of the airfoil surface adjoining the root portion of the blade.

8. A bladed rotor for a compressor comprising:

a rotor disk with a plurality of blade root insertion holes to receive a blade root portion;

each blade insertion hole having a pressure side shear pin slot and a suction side shear pin slot;

a fan blade having an airfoil portion and a root portion, the root portion having shear pin slots formed thereon;

two shear pins inserted into the slots such that the blade insertion hole secures the blade within the rotor disk in the axial and circumferential directions of the rotor disk while the shear pins secure the blade in the radial direction; and, the shear pins have a length substantially equal to the length of the slots formed in the blade root portion.

* * * * *